US005584475A

United States Patent [19]

Asada et al.

[11] Patent Number: 5,584,475

[45] Date of Patent: Dec. 17, 1996

[54] SHEET FEEDING DEVICE

[75] Inventors: Tetsuo Asada, Kuwana; Toshio Sugiura, Anjo, both of Japan

[73] Assignee: Brother Kogyo Kabushiki Kaisha, Nagoya, Japan

[21] Appl. No.: 423,449

[22] Filed: Apr. 19, 1995

[30] Foreign Application Priority Data

May 19, 1994 [JP] Japan ..... 6-105477

[51] Int. Cl.[6] ..... B65H 3/52

[52] U.S. Cl. ..... 271/121

[58] Field of Search ..... 271/119, 109, 271/121

[56] References Cited

U.S. PATENT DOCUMENTS

| | | | |
|---|---|---|---|
| 4,607,833 | 8/1986 | Sugatsky et al. | 271/109 |
| 4,653,742 | 3/1987 | Sasaki et al. | 271/119 |
| 4,696,462 | 9/1987 | Tanaka et al. | 271/121 |
| 5,052,677 | 10/1991 | Kishibata | 271/121 |
| 5,372,359 | 12/1994 | Miura et al. | 271/121 |

FOREIGN PATENT DOCUMENTS

| | | | |
|---|---|---|---|
| 63-37044 | 2/1988 | Japan . | |
| 48909 | 9/1989 | Japan | 271/119 |
| 49104 | 4/1991 | Japan | 271/119 |
| 49305 | 5/1993 | Japan | 271/109 |

*Primary Examiner*—William E. Terrell
*Assistant Examiner*—T. Kelly
*Attorney, Agent, or Firm*—Oliff & Berridge

[57] ABSTRACT

A sheet feed roller that rotates intermittently has a contact face for contacting with the surface of a sheet and a non-contacting face that does not contact with the surface of a sheet. A holder opposed to a circumferential face of the sheet feed roller has a recess on the surface thereof. A separation pad made of a material having a high coefficient of friction is disposed in a portion of the recess upstream in a feeding direction of a sheet, while a PET film serving as a noise deadening control element made of a material having a low coefficient of friction is disposed in another portion of the recess adjacent to the separation pad downstream in the feeding direction such that the surface thereof has a height substantially equal to that of the surface of the separation pad. The sheet feed roller is disposed such that the contact face thereof extends over both the separation pad and the noise deadening control element. The construction is effective to prevent noise generated by a sheet frictionally separated and supplied by the separation pad having a high coefficient of friction and the sheet feed roller or by vibrations of the holder member.

25 Claims, 9 Drawing Sheets

SHEET FEEDING DEVICE

BACKGROUND OF THE INVENTION

1. Field of the Invention

This invention relates to a structure of a sheet feeding device for an image forming apparatus such as a laser printer, a copying machine or a facsimile apparatus. More particularly, this invention relates to a structure of a sheet feeding device wherein recording medium layered in a sheet feeding station, such as a sheet feed cassette are separated and fed one by one from the top position thereof.

2. Description of the Related Art

Various sheet feeding devices for an image forming apparatus such as a laser printer for feeding cut sheets of a predetermined size are known. An example of a conventional sheet feeding device is the frictional separation type device disclosed in Japanese Unexamined Patent Publication No. 63-37044.

In particular, in the frictional separation type device, a large number of sheets are received on a receiving plate normally biased upwardly in a sheet feed cassette, and a sheet feed shaft, which is driven to rotate intermittently, is disposed adjacent to an end portion above an uppermost one of the sheets. A sheet feed roller having a substantially D-shaped cross section and having a circumferential portion formed of a member having a high coefficient of friction is secured to an intermediate portion of the sheet feed shaft. A pair of cylindrical sheet feed collars having a diameter slightly smaller than that of the circumferential portion of the sheet feed roller are fitted for rotation at the opposite end portions of the sheet feed roller. When the sheet feed shaft is driven to rotate by a predetermined angle by a motor, the circumferential portion of the sheet feed roller is contacted under pressure with the surface of the sheet at the uppermost position so that the uppermost sheet is pushed out forwardly (downstream in the feeding direction) by the sheet feed roller due to the friction of the circumferential portion of the sheet feed roller.

When the uppermost sheet is pushed out, also other sheets underlying the uppermost sheet are dragged so that a plurality of sheets are sometimes pushed out at a time. Such phenomenon is called "dual feed." In order to prevent such dual feed, a separation pad holder made of a synthetic resin is conventionally disposed at a location at the height of the uppermost sheet immediately downstream of the sheet in the sheet feeding direction on the side on which it is opposed to the circumferential face of the sheet feed roller. The separation pad holder is provided, at an upper face thereof (the side opposed to the circumferential face of the sheet feed roller), with a separation pad member having a coefficient of friction a little lower than that of the material of the sheet feed roller. The separation pad roller is normally biased by a spring so that it approaches the circumferential face of the sheet feed roller.

When the circumferential portion of the sheet feed roller being driven to rotate is opposed to the surface of the separation pad, the sheet feed roller pushes down the separation pad roller against the biasing force of the spring by the sheets. In this condition, the uppermost sheet is pushed out downstream in the feeding direction by the frictional force of the circumferential portion of the sheet feed roller. Meanwhile, since resistance acts on the other sheets underlying the uppermost sheet to prevent them from being pushed out by the friction of the separation pad, only the uppermost (single) sheet is pushed out and fed to a pair of transport sheet rollers located downstream in the feeding direction with respect to the separation pad holder.

It is to be noted that when the sheet feed roller is rotated by a predetermined angle until a flat portion thereof having a smaller diameter is opposed to the separation pad holder, the outer circumferential faces of the sheet feed collars greater in diameter than the flat portion of the sheet feed roller and freely rotatable with respect to the sheet feed roller contact with the surface of the uppermost sheet sent out while the rear face of the sheet being sent out contacts with the separation pad.

However, in the above structure, the separation pad is provided both in the upstream and the downstream of the sheet feeding direction from a portion where the sheet feed roller and the separation pad contact each other. Therefore, while the uppermost sheet separated from the other underlying sheets by the sheet feed roller and the separation pad is being sent out by the transport roller pair, the uppermost sheet being sent out remains in a condition where it is contacted under pressure by and between the sheet feed collars and the separation pad. Consequently, the rear face of the uppermost sheet being sent out rubs on the surface of the separation pad and some play is present at a location where the separation pad is mounted for rocking motion so as to press against the circumferential face of the sheet feed roller. There is a problem in that when a sheet is fed, the sheet and/or the separation pad vibrate and generate noise, such as chattering.

SUMMARY OF THE INVENTION

In order to solve at least the problem described above, the following three solutions have been developed herein.

(1) Downstream in the feeding direction with respect to the location at which a sheet is held between the sheet feed roller and the separation pad, a member is located that contacts with the front face or the rear face of the sheet to stop vibrations of the sheet.

(2) The pushing force of the separation pad against the sheet feed roller is reduced.

(3) The holder member provided with the separation pad is designed, particularly with respect to weight and rigidity, to change the resonance point of the holder member to reduce vibrations.

However, while the first solution can stop vibrations of a sheet, it cannot eliminate vibrations of the holder member itself. With the second solution, the possibility that a sheet may not be separated completely is so high that the phenomenon of dual feed may occur. With the third solution, while vibrations of the holder member itself can be reduced, a noise generating phenomenon still occurs due to a difference in sheet thickness, sheet weight per unit area, flexibility of sheet and so forth.

An object of the present invention is to provide a sheet feeding device that stops vibrations of a recording medium such as a sheet and a holder member to prevent generation of noise with a comparatively simple structure.

To attain at least the object described above, according to the present invention, a sheet feeding device is provided with a sheet storing member for storing a plurality of sheets, a sheet feeding roller for feeding a sheet from the sheet storing member, a separating member having a high coefficient of friction and disposed facing the sheet feeding mechanism for separating an uppermost sheet of the plurality of sheets, and a noise deadening member having a coefficient of friction lower than a coefficient of friction of the separating member and disposed facing the sheet feeding roller in a lower side of a feeding direction of a sheet from the separating member. Further, the sheet feeding roller is disposed such that the circumferential face thereof extends over both of the separating member and the noise deadening member.

In the sheet feeding device, a plurality of sheets stored in the storing member are frictionally separated and fed one by one by the sheet feeding roller and the separating member for pressing a sheet at a rear surface against a circumferential face of the sheet feeding roller. The noise deadening member made of a material having a lower coefficient of friction than a coefficient of friction of the separating member is disposed in a downstream side of the feeding direction from the separating member. The sheet feeding roller is disposed such that the circumferential face thereof extends over both of the separating member and the noise deadening member.

Accordingly, when a sheet held between and separated with certainty by the circumferential face of the sheet feeding roller and the separation member having a high coefficient of friction comes to the noise deadening member located adjacent to the separation member downstream in the feeding direction and having a low coefficient of friction, the frictional resistance to the sheet decreases suddenly. Consequently, the sheet is fed smoothly between the noise deadening member and the circumferential surface of the sheet feeding roller. As a result, generation of noise can be prevented.

BRIEF DESCRIPTION OF THE DRAWINGS

Preferred embodiments of the present invention are described in detail with reference to the following figures, wherein.

DETAILED DESCRIPTION OF PREFERRED EMBODIMENTS

Figure 1:
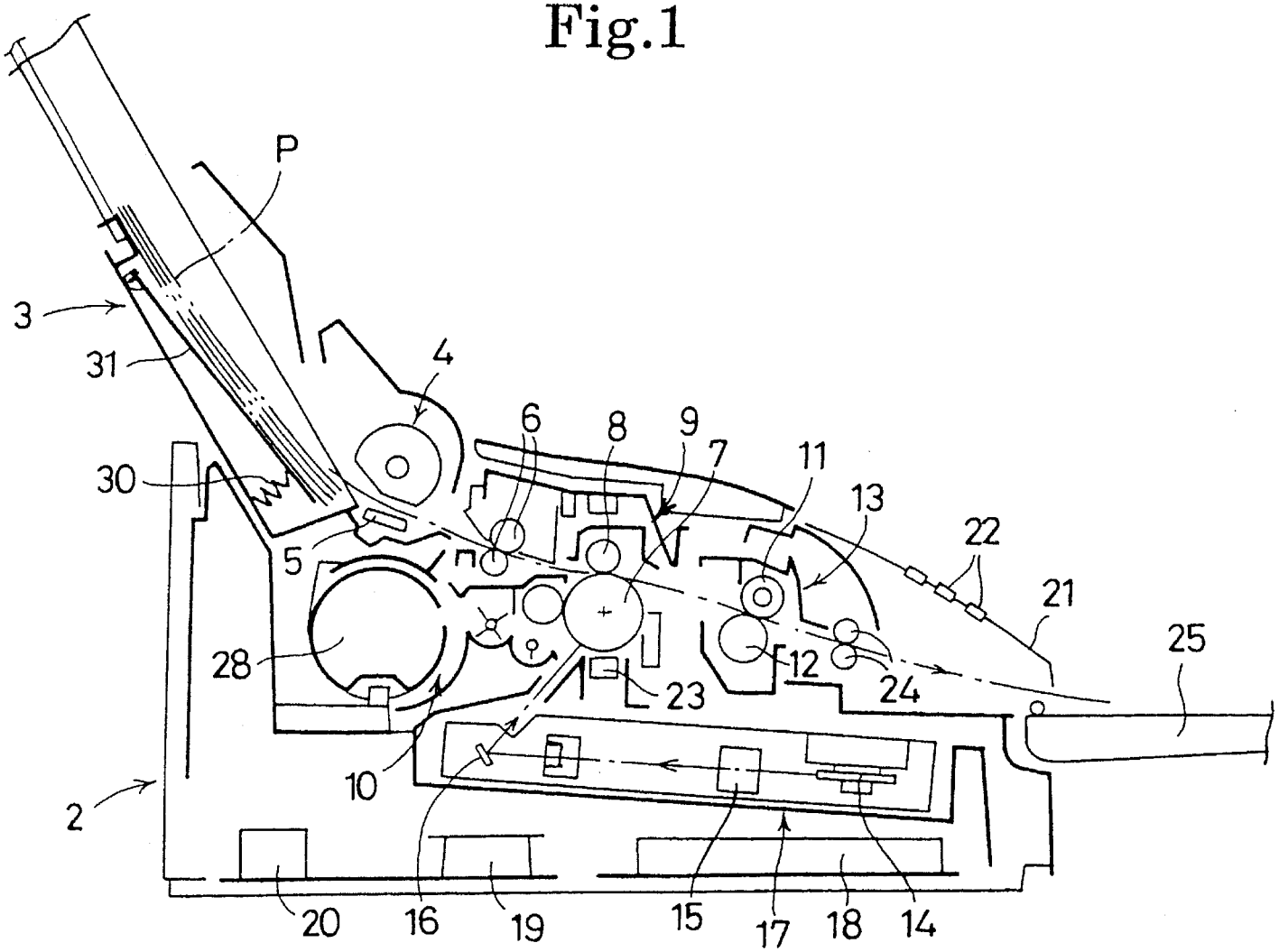
FIG. 1 is a schematic side elevational sectional view of a laser printer.
Figure 2:
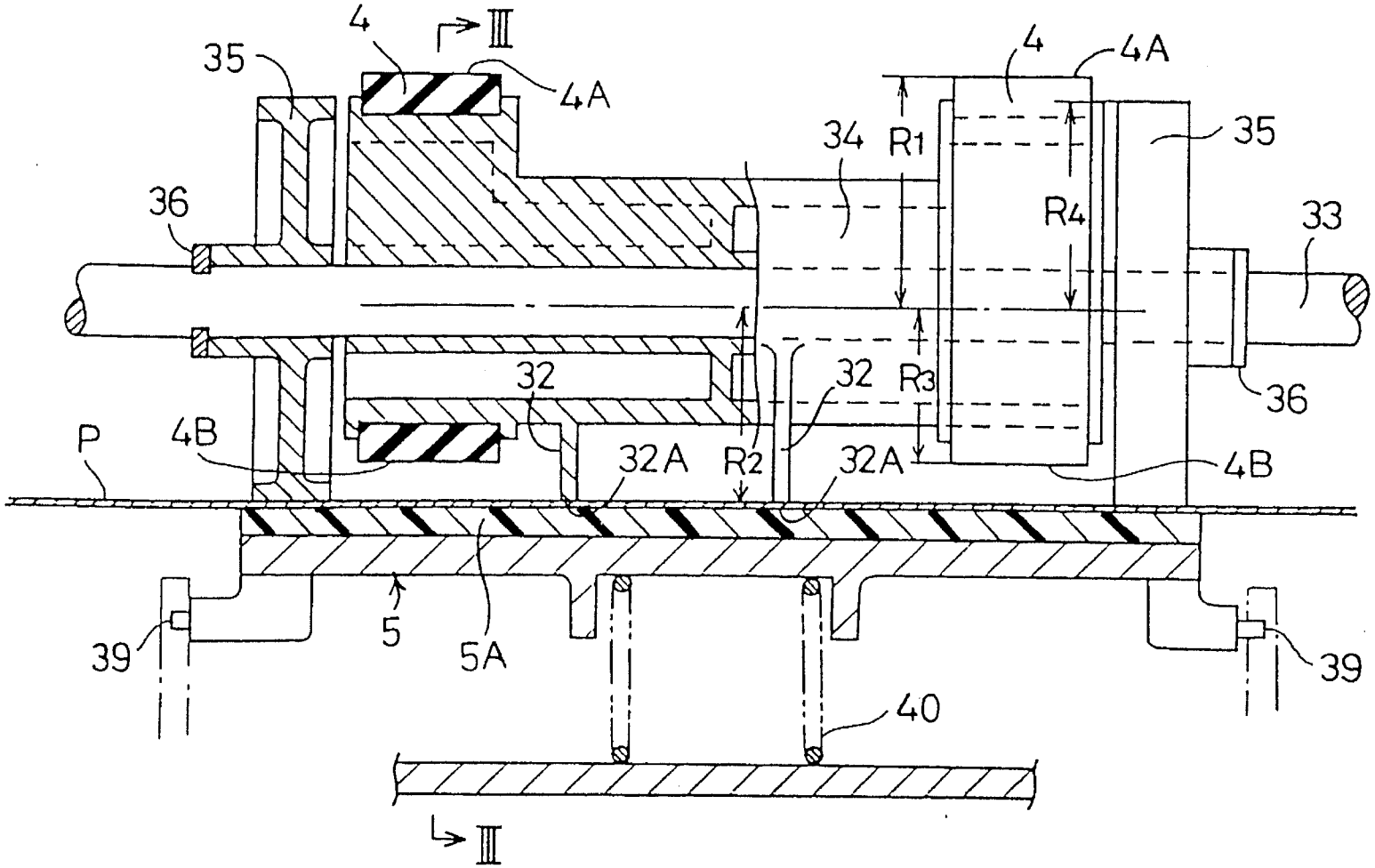
FIG. 2 is a front elevational view partly in section of a sheet feeding device.

Preferred embodiments of the present invention will be described below. FIG. 1 is a schematic side elevational sectional view of a printer 1 as an image forming apparatus, and FIG. 2 is a partial side elevational sectional view of a sheet feeding device. In the printer 1 in the present embodiment, a sheet feed cassette 3 is removably mounted at an upper portion of one side of a body case 2. Sheets P, such as recording media, layered in the sheet feed cassette 3 are separated and taken out one by one from the sheet feed cassette 3 by a pair of sheet feed rollers 4 and a holder member 5, which is provided with a separation pad 5A. The sheet P thus taken out is transported by way of a transport roller pair 6 to a photosensitive unit 9 that includes a photosensitive drum 7, a transfer roller 8 and so forth. A development unit 10 to which toner powder is supplied from a toner cartridge 28 is disposed adjacent to the photosensitive unit 9 on the side nearer to the sheet feed cassette 3. A fixing unit 13 including a heating roller 11 and a pressure roller 12 is disposed adjacent to the photosensitive unit 9 apart from the sheet feed cassette 3.

Disposed below the photosensitive unit 9 are a scanner unit 17 including a laser light emission section 14, a lens 15, a reflecting mirror 16, a pair of control circuit boards 18 and 19, a power source unit 20, and a plurality of operation buttons 22 provided on a cover member 21.

Light emitted from the scanner unit 17 is irradiated upon the surface of the photosensitive drum 7, which has been charged in advance by a charger 23 in response to image data transmitted from an external equipment such as a computer, not shown, so that an electrostatic latent image is formed on the surface of the photosensitive drum 7. Then, development occurs wherein the latent image is converted into a visible image with toner powder that has been supplied to and magnetized by the development unit 10. Thereafter, the toner image is transferred to a sheet P as a recording medium supplied between the photosensitive drum 7 and the transfer roller 8, and heat and pressure are applied to the thus transferred toner image to fix the toner image to the sheet P. Then, the sheet P is discharged from a discharge roller pair 24 to a discharge sheet tray 25 of the printer 1.

The sheet feeding device including the sheet feed rollers 4 and the holder member 5, which includes the separation pad 5A and a noise deadening control portion 26, are described with reference to FIGS. 2 to 7.

Figure 3:
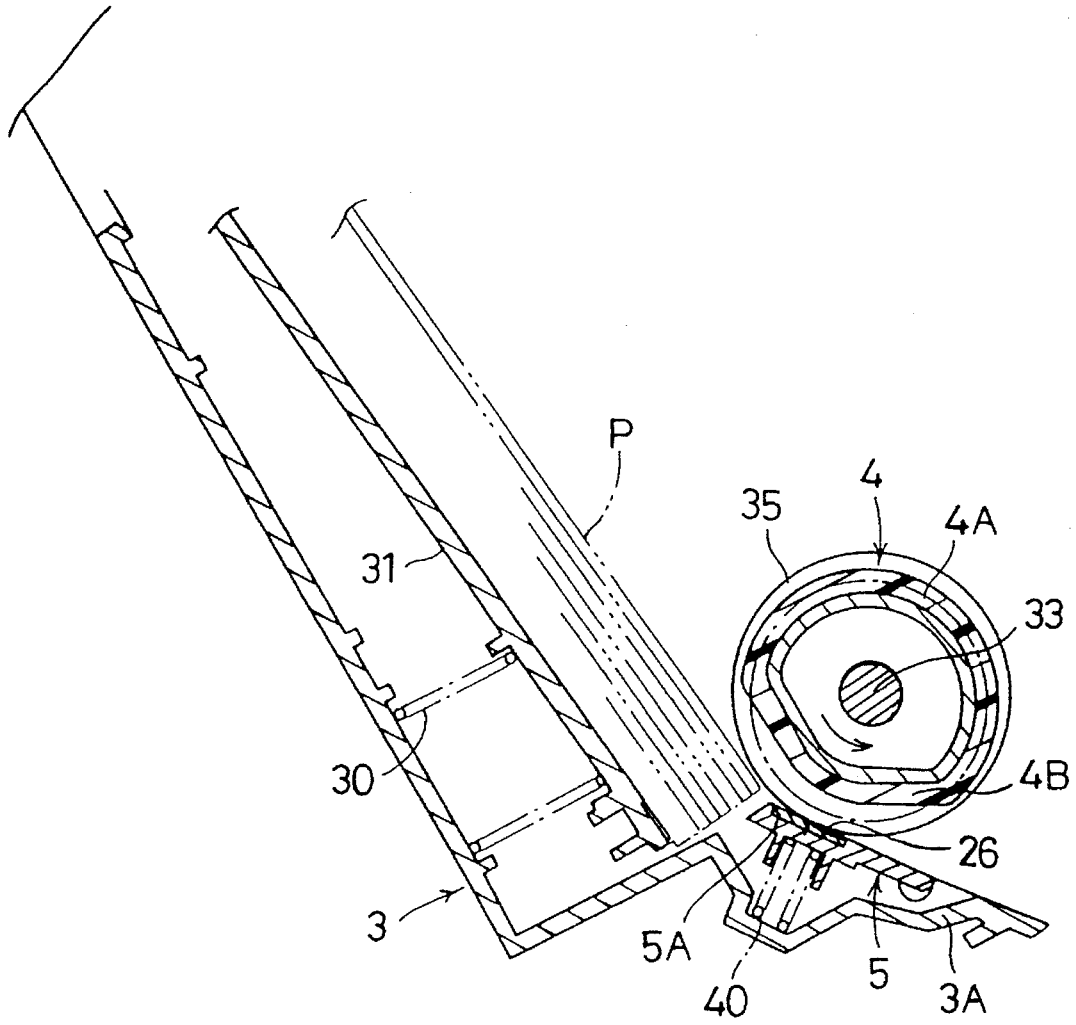
FIG. 3 is a partial side elevational sectional view taken along line III—III of FIG. 2.

A sheet receiving plate 31, seen in FIG. 3, is disposed in the sheet feed cassette 3 of the sheet feeding device and is normally biased upwardly by a spring 30 so as to approach the lower faces of the sheet feed rollers 4. Thus, the upper face at a lower end portion of one of a large number of sheets P layered on the sheet receiving plate 31 is located at an uppermost position is located adjacent to the circumferential faces of the sheet feed rollers 4.

The sheet feed rollers 4 in the present embodiment are formed at the opposite right and left end portions of a tubular member 34 made of a synthetic resin that is rotated integrally with a drive shaft 33 rotated intermittently by a drive motor (not shown) by way of a transmission gear mechanism. Each of the sheet feed rollers 4 has a substantially D-shaped cross section and has an outer peripheral face including a contact face 4A in the form of a circumferential face for contacting with a sheet P and a non-contacting face 4B that does not contact with a sheet P. At least the contact face 4A is made of a material having a high coefficient of friction such as rubber.

It is to be noted that, in the present embodiment, the sheet feed rollers 4 made of ring-shaped rubber elements are fitted at the sheet feed roller location corresponding portions at the opposite right and left end portions of the tubular member 34. Further, as shown in FIG. 2, a plurality of flange portions 32 are formed projectingly in a suitably spaced relationship from each other along the longitudinal direction on the outer periphery of an intermediate portion of the tubular member 34 in the longitudinal direction. The outer diameter (R2) of the flange portions 32 is slightly smaller than the outer radius (R1) of the contact faces 4A. The projecting positions of the flange portions 32 preferably correspond to the non-contacting faces 4B at which the sheet feed rollers 4 have a smaller outer radius (R3) to prevent deflection of a sheet P.

A pair of tubular sheet feed collars 35 made of a synthetic resin are loosely fitted at locations of the drive shaft 33 sideways of the opposite right and left sheet feed rollers 4. The sheet feed collars 35 loosely fitted in this manner are held from being displaced axially with respect to the drive shaft 33 by a pair of stop rings 36 (refer to FIG. 2). The outer radius (R4) of the sheet feed collars 35 is set a little smaller than the outer radius (R1) of the sheet feed rollers 4 at the contact faces 4A. The relationship between the outer radius (R1) of the contact faces 4A of the sheet feed rollers 4 and the outer radium (R4) of the sheet feed collars 35 is set in such a manner as described below. In particular, the outer radius (R1) of the contact faces 4A and the outer radius (R4) of the sheet feed collars 35 are set so that, in such a rotational phase wherein the non-contacting faces 4B of the sheet feed rollers 4 are opposed to a sheet P, each of the sheet feed collars 35 presses both of the surfaces of a separation pad 5A and a noise deadening control portion 26, which is hereinafter described to press the surface of the sheet P positioned on the separation pad 5A and the noise deadening control portion 26. Further, the outer radius (R1) of the contact faces 4A and the outer radius (R4) of the sheet feed collars 35 are set so that, in another rotational phase wherein the contact faces 4A of the sheet feed rollers 4 are opposed to a sheet P, the circumferential faces of the sheet feed collars 35 just contact with the surface of the sheet P.

Further, the holder member 5 is mounted for upward and downward pivotal motion around a pair of pivotally supporting shaft elements 39 on the opposite right and left sides of a base end thereof in an inner space 3A of the lower end of the sheet feed cassette 3 or in the proximity of the lower end of the sheet feed cassette 3. The holder member 5 is normally biased by a spring 40 so that the surface (upper face) thereof approaches the circumferential faces of the sheet feed rollers 4 (refer to FIGS. 3 to 5).

The separation pad 5A made of a material having a high coefficient of friction such as a foamed urethane resin is disposed on the surface of the holder member 5 upstream in the feeding direction of a sheet P. The noise deadening control portion 26 at least whose surface layer is made of a material having a low coefficient of friction such as a film 43 of very high molecular polyethylene is fixedly disposed adjacent to the separation pad 5A downstream in the feeding direction. The material of the separation pad 5A is only required to have a coefficient of friction lower than that of the sheet feed rollers 4 and higher than those of the sheet and the noise deadening control portion 26. For example, a foamed urethane resin mentioned hereinabove, a rubber material or a cork material may be used. Further, the film of the noise deadening control portion 26 may be, for example, a film of very high molecular polyethylene mentioned hereinabove or a PET film.

Figure 6:
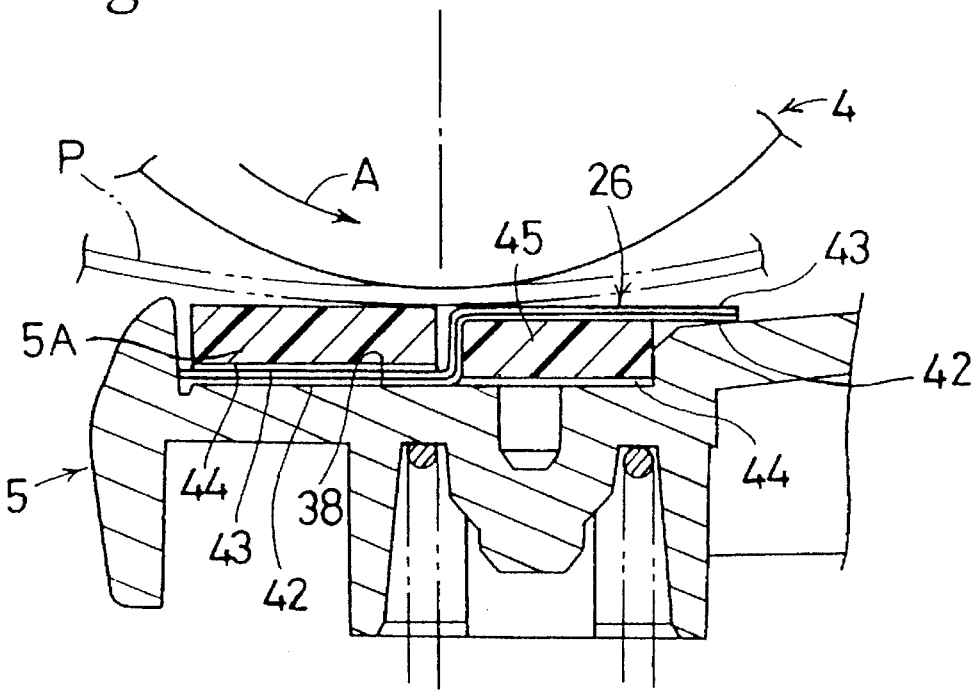
FIG. 6 is a partial side elevational sectional view of the holder member.

In one form of the sheet feeding device shown in FIG. 6, a recess 38 elongated in a direction perpendicular to the feeding direction of a sheet P is formed on the front face of the holder member 5, and the film 43 of approximately 0.1 mm thickness such as a film of very high molecular polyethylene fixedly adheres to a half of the bottom face of the recess 38 upstream in the feeding direction by an adhesive double coated tape 42. The separation pad 5A fixedly adheres to an upper face of the thus fixedly adhering film 43 similarly by an adhesive double coated tape 44. The film 43 and the adhesive double coated tape 42 are bent along a face of the separation pad 5A downstream in the feeding direction. A support element 45 made of the same material and having an equal thickness as the separation pad 5A fixedly adheres to a portion of the bottom face of the recess 38 downstream in the feeding direction similarly by another adhesive double coated tape 44. Further, a half of the film 43 downstream in the feeding direction fixedly adheres to an upper face of the support element 45 by way of the adhesive double coated tape 42. By constructing the separation pad 5A and the noise deadening control portion 26 in this manner, the vertical positions of the surfaces of both of the separation pad 5A and the noise deadening control portion 26 can be made coincident with each other. The total thickness of the film 43 and the adhesive double coated tape 42 is about 0.1 to 0.4 mm, and preferably, 0.2 to 0.3 mm.

Figure 7A:
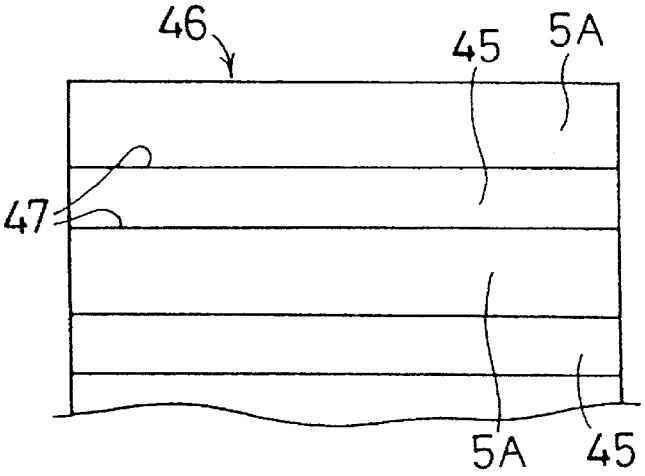
FIG. 7A is a partial side elevational view of a separation pad and a support element.
Figure 7B:
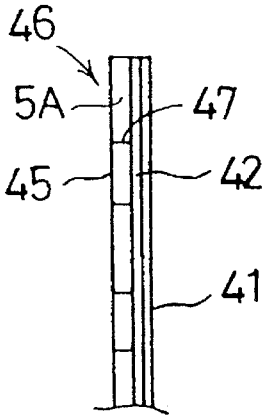
FIG. 7B is a partial side elevational view of the separation pad and the support element.

The separation pad 5A and the noise deadening control portion 26 having an equal thickness can be produced by such a method as described below. As shown in FIGS. 7A and 7B, a plate element 46 of a foamed urethane resin having a thickness of approximately 1.5 mm and having a dynamic friction coefficient $\mu$ of about 0.8–1.0 adheres to a mount 41 by an adhesive double coated tape 42. Then, cutting lines 47 are formed at predetermined intervals so that adjacent portions of the plate element 46 of a foamed urethane resin adhering to the mount 41 make a set of the separation pad 5A and the support element 45 and allow the separation pad 5A and the support element 45 to be separated from each other. By this method, such formation of the separation pad 5A and the support element 45 with a substantially equal thickness can be realized comparatively simply.

Subsequently, a sheet feeding operation of the sheet feeding device constructed in such a manner as described above is described. First, in an initial condition (sheet feed waiting condition), the lower portions of the outer circumferential faces of the sheet feed collars 35 on the drive shaft 33 contact with the surfaces of both the separation pad 5A on the surface of the holder member 5 and the noise deadening control portion 26. The non-contacting faces 4B of the sheet feed rollers 4 are held spaced from the surfaces of the separation pad 5A and the noise deadening control portion 26.

Then, if a printing instruction is inputted to the printer 1 and a sheet feeding instruction is developed from the control circuit board 18 or 19, the drive motor, not shown, is rendered operative to rotate the drive shaft 33 one rotation. So, the sheet feed rollers 4 are rotated in the direction indicated by an arrow marked A in FIG. 4.

Figure 4:
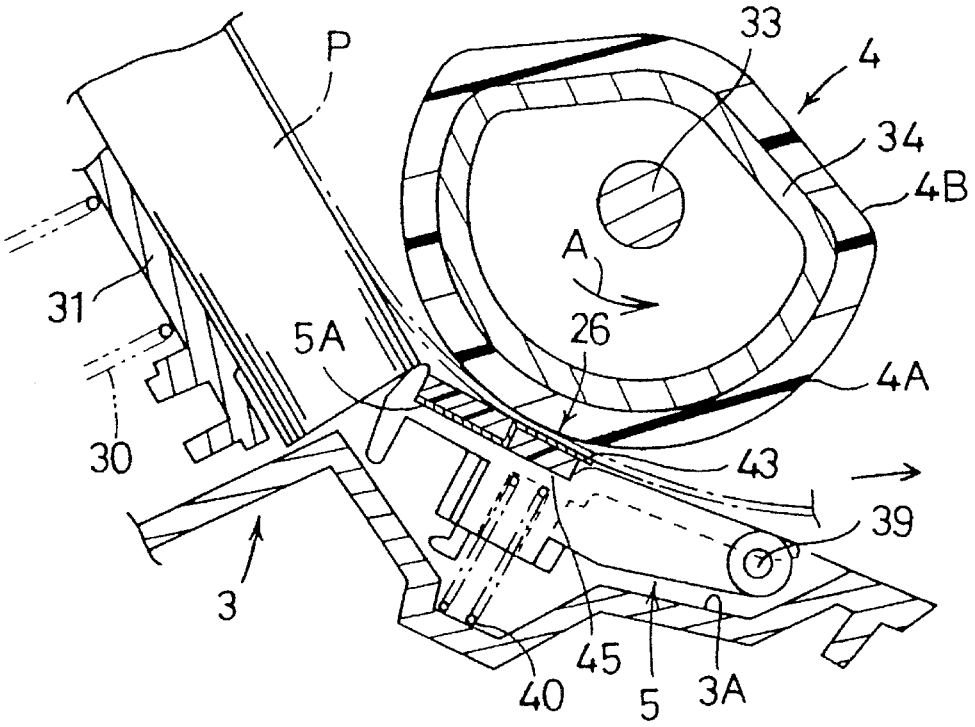
FIG. 4 is a schematic side view partly in section of the sheet feeding device of FIG. 2 when a contact face of a sheet feed roller is opposed to a sheet.
Figure 5:
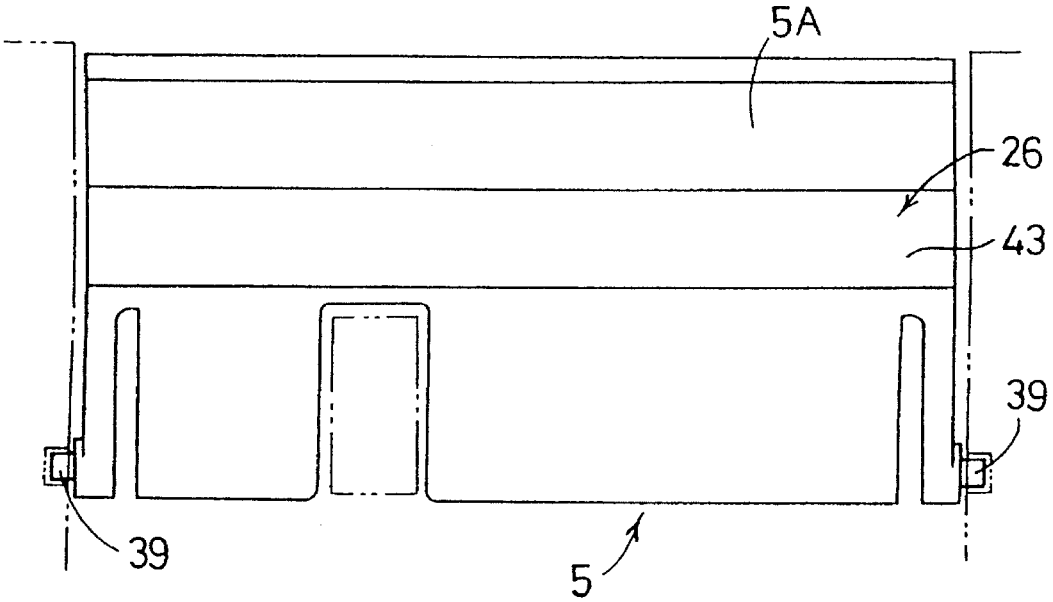
FIG. 5 is a plan view of a holder member.

During the rotation, when the contact faces 4A of the sheet feed rollers 4 begin to contact with the separation pad 5A, a leading end portion of an uppermost one of the sheets P layered in the holder member 5 is introduced between the contact faces 4A having a high coefficient of friction and the separation pad 5A. Here, since the coefficient of friction of the sheet feed rollers 4 is higher than the coefficient of friction of the separation pad 5A, only the uppermost sheet P is sent out and transported by the sheet feed rollers 4. Then, when the leading end of the sheet P comes to the location on the surface of the film 43 serving as the noise deadening control portion 26, as seen in FIGS. 4 and 6, it contacts now with the surface of the film 43, which has a coefficient of friction lower than that of the separation pad 5A. Consequently, since the sheet P can slip smoothly on the film 43, the film 43 exhibits an action of canceling chattering noise of the sheet P being fed and vibration noise of the holder member 5.

While, in the first embodiment described above, the separation pad 5A and the support element 45 are made of the same material, the support element 45 need not necessarily be made of the same material as that of the separation pad 5A if they have an equal thickness.

Figure 8A:
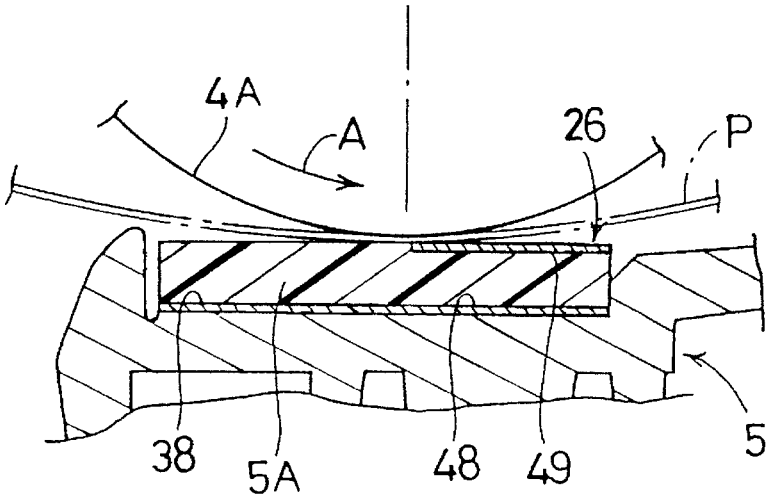
FIG. 8A is a partial side elevational sectional view of a second embodiment.

In a second embodiment shown in FIG. 8A, the separation pad 5A made of a foamed urethane resin is provided over the entire area of the bottom face of the recess 38 of the holder member 5 by an adhesive double coated film 48. Further, a resin or a like material having a low coefficient of friction is applied or a thin stainless steel plate having a low coefficient of friction or a film of very high molecular polyethylene or a PET film is provided as a surface layer 49 to the separation pad 5A or on a portion of the surface of the separation pad 5A downstream in the feeding direction to form the noise deadening control portion 26. Also in this instance, it is essentially required to form the surface layer 49 so that there is no offset between the surface layer 49 and the separation pad 5A and the surfaces are flush. If an offset is present between the surface layer 49 and the separation pad 5A, the leading end of a sheet P fed thereto will collide with the offset, which obstructs a smooth sheet feeding operation and sometimes causes sheet jamming.

Figure 8B:
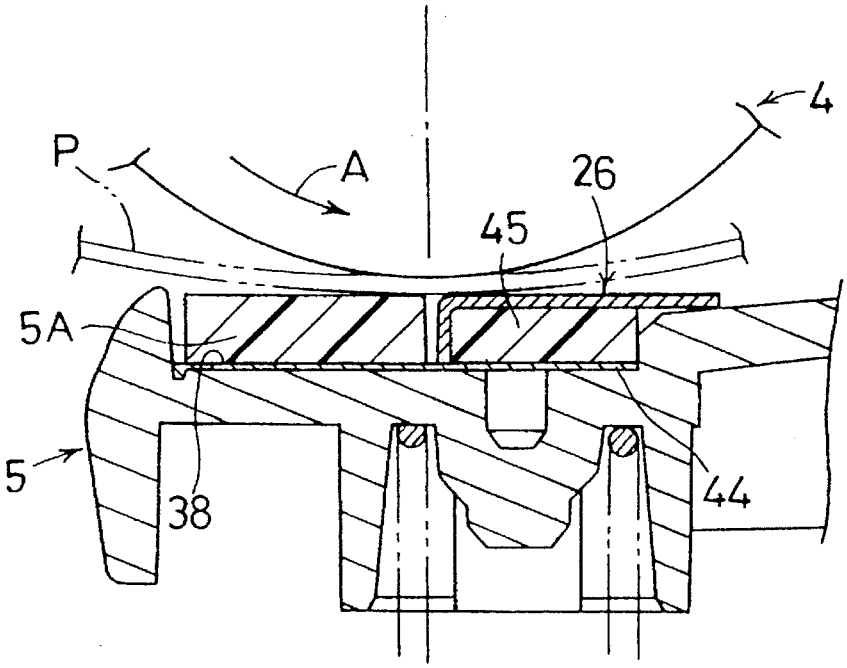
FIG. 8B is a partial side elevational sectional view of a third embodiment.

In a third embodiment shown in FIG. 8B, the separation pad 5A and the support element 45 are fixedly arranged in the recess 38 on the surface of the holder member 5 by the adhesive double coated tape 44. Further, a film of very high molecular polyethylene, a PET film, a resin or a stainless steel plate is disposed as the noise deadening control portion 26 over an area from a face of the support element 45 downstream in the feeding direction to the upper face of the support element 45. Also in this instance, it is essentially required to form the support element 45, the noise deadening control portion 26 and the separation pad 5A such that the total thickness of the support element 45 and the noise deadening control portion 26 is equal to the thickness of the separation pad 5A.

Figure 9:
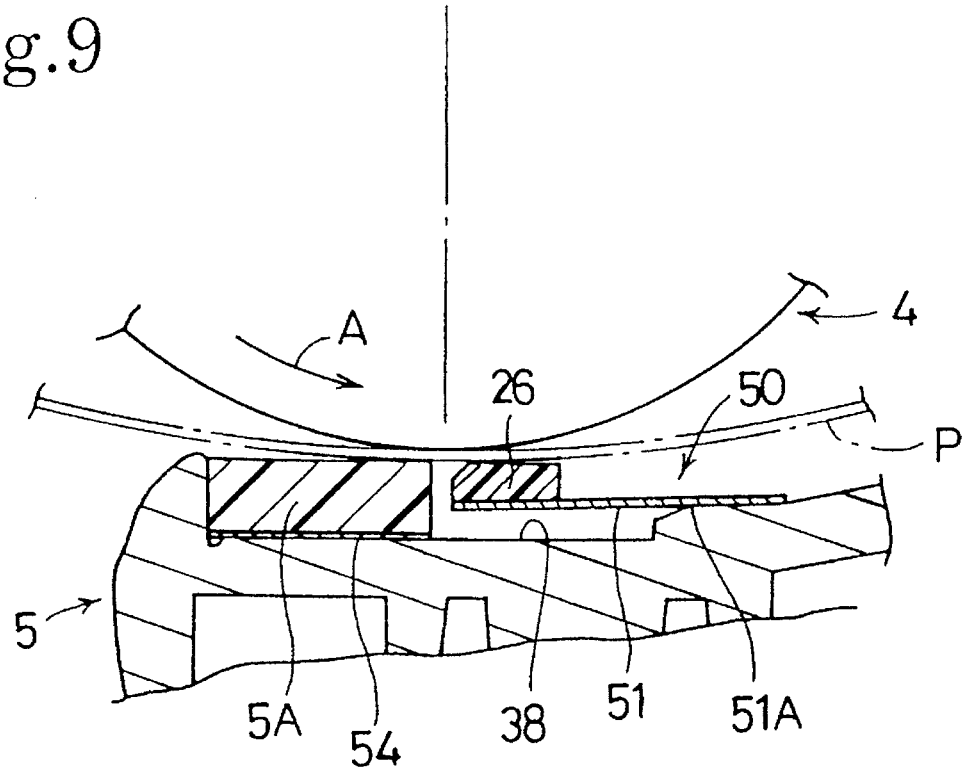
FIG. 9 is a partial side elevational sectional view of a fourth embodiment.
Figure 10:
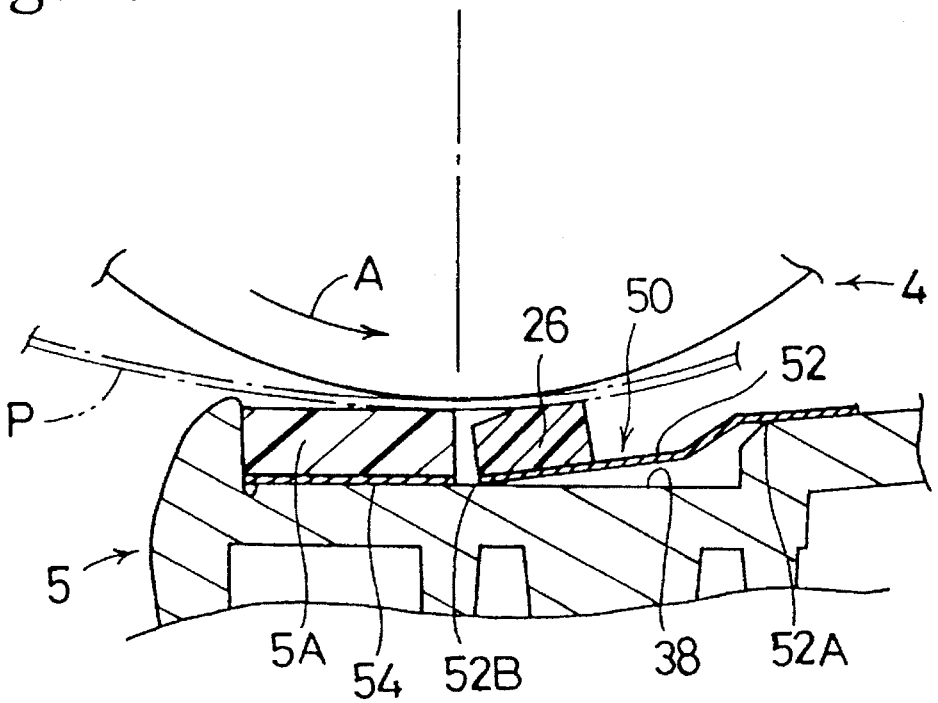
FIG. 10 is a partial side elevational sectional view of a fifth embodiment.

In embodiments shown in FIGS. 9 and 10, the separation pad 5A is fixed to a portion of the recess 38 upstream in the feeding direction on the front face side of the holder member 5 by an adhesive double coated tape 54. Further, in the embodiments shown in FIGS. 9 to 11, the noise deadening control portion 26 made of a material having a low coefficient of friction, such as a resin, is disposed adjacent to the separation pad 5A, which is fixed to a portion of the recess 38 upstream in the feeding direction on the front face side of the holder member 5. Further, the noise deadening control portion 26 is normally biased by a resilient member 50 so as to contact with the circumferential faces of the sheet feed rollers 4.

In the fourth embodiment shown in FIG. 9, a leaf spring 51 having a base end securely mounted downstream of the holder member 5 in the feeding direction extends into the recess 38. Further, an end portion of the noise deadening control portion 26 upstream in the feeding direction is chamfered in a flat face or a convex face such that it descends forwardly. The construction makes it easy for a sheet P to ride over to the noise deadening control portion 26. Consequently, occurrence of sheet jamming is prevented.

In the present fourth embodiment, a portion 51A in the proximity of a base end of the leaf spring 51, which is spaced away by a great distance from the noise deadening control portion 26, serves as a load supporting point. Thus, a condition wherein the pressing force of the noise deadening control portion 26 against the sheet feed rollers 4 is weak can be realized.

In the fifth embodiment shown in FIG. 10, an end (free end side) 52B of a leaf spring 52 on which the noise deadening control portion 26 is resiliently supported is held in contact with the bottom face of the recess 38. Consequently, the leaf spring 52 is supported at two points of the end 52B of the leaf spring 52, which contacts with the bottom face of the recess 38 and a portion 52A adjacent to a base end of the leaf spring 52. As a result, there is an effect that the noise deadening control portion 26 can be pressed with a high pressing force against the circumferential faces of the sheet feed rollers 4.

Figure 11:
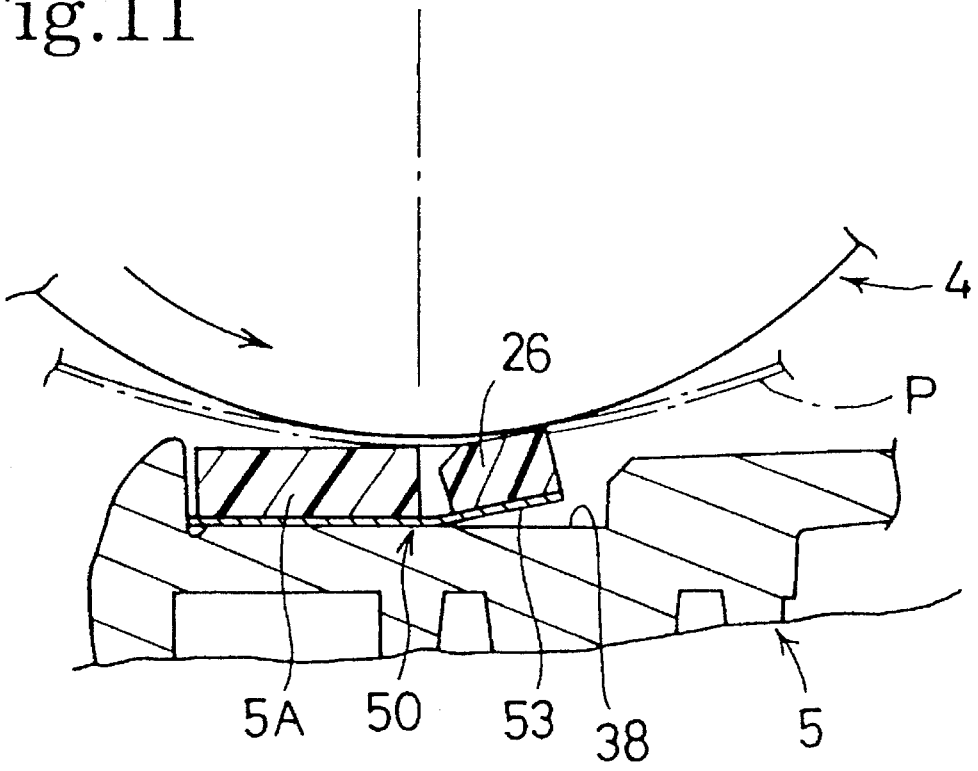
FIG. 11 is a partial side elevational sectional view of a sixth embodiment.

In the sixth embodiment shown in FIG. 11, a leaf spring 53 fixedly adheres to the bottom face of the recess 38. The separation pad 5A is secured to a base portion side (upstream in the feeding direction) of the thus fixedly adhering leaf spring 53. Further, the leaf spring 53 is bent such that a portion thereof downstream in the feeding direction is upwardly spaced away from the bottom face of the recess 38, and the noise deadening control portion 26 fixedly adheres to an upper face of the leaf spring 53 in the bent condition. In the present fifth embodiment, since the length of the leaf spring 53 upwardly spaced away from the bottom face of the recess 38 is small, the noise deadening control portion 26 can be pressed with a high pressing force against the circumferential faces of the sheet feed rollers 4.

In the fourth embodiment described above, the pressing force of the noise deadening control portion 26 against the sheet feed rollers 4 can be set low. However, in the fifth and sixth embodiments described above, the pressing force of the noise deadening control portion 26 against the sheet feed rollers 4 can be set high. The sheet feeding device in the fourth, fifth and sixth embodiments described above can be selectively employed based on the thickness, the rigidity and so forth of sheets to be used. For example, in the sheet feeding device in the fourth embodiment, since the pressing force of the noise deadening control portion 26 against the sheet feed rollers 4 is low, a sheet can be transported smoothly whether the thickness of the sheet is great or small or the rigidity of the sheet is high or low. On the other hand, in the sheet feeding device in the fifth and sixth embodiments, since the pressing force of the noise deadening control portion 26 against the sheet feed rollers 4 is high, they are suitable to transport a sheet having a great thickness or a high rigidity.

Figure 12:
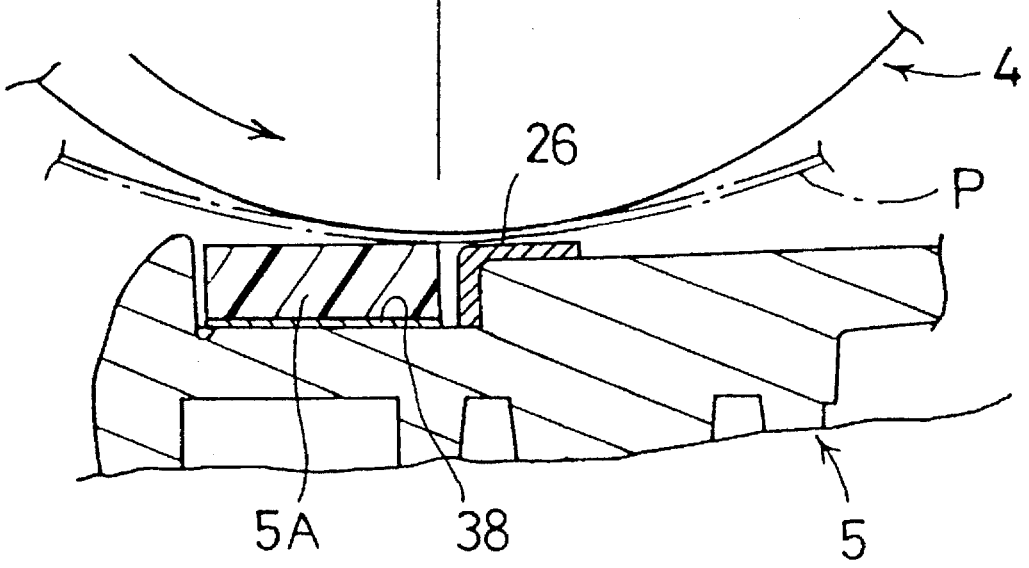
FIG. 12 is a partial side elevational sectional view of a seventh embodiment.

In a seventh embodiment shown in FIG. 12, the recess 38 of the holder member 5 is formed only upstream in the feeding direction. The separation pad 5A is fixedly provided in the recess 38. Further, the noise deadening control portion 26 is provided on a face of the recess 38 downstream in the feeding direction and the upper face of the holder member 5. The noise deadening control portion 26 is formed of a film of very high molecular polyethylene, PET or resin, stainless steel plate, or the like.

It is to be noted that the following relationships are satisfied in all of the embodiments.

Coefficient of friction of sheet feed roller>Coefficient of friction of separation pad>Coefficient of friction of noise deadening control portion.

Coefficient of friction of sheet feed roller>Coefficient of friction of separation pad>Coefficient of friction of sheet.

Preferable coefficient of friction μ of sheet feed roller is about 1.2–1.5. Preferable coefficient of friction μ of separation pad is about 0.8–1.0. Preferable coefficient of friction μ of noise deadening control portion is equal to or less than 0.5.

In this manner, the noise deadening control portion 26 having a coefficient of friction lower than those of the sheet feed rollers 4 and the separation pad 5A is disposed downstream of the separation pad 5A in the feeding direction. Consequently, only an uppermost sheet P is taken out and transported by the separation pad 5A and the sheet feed rollers 4, and frictional noise or chattering noise produced by vibrations of a sheet or the separation pad 5A or the holder member 5 can be prevented.

It is to be noted that, during a sheet feeding operation, at a position where the non-contacting faces 4B of the sheet feed rollers 4 are opposed to the surface of the holder member 5, the circumferential faces of the sheet feed collars 35 and circumferential faces 32A of the flange portions 32 contact with the surface of a sheet P as seen in FIG. 2.

Then, when the sheet feed rollers 4 are rotated one rotation, they return to and stop at a position of the phase in which the non-contacting faces 4B thereof are opposed to the holder member 5.

Further, the sheet feeding device of the present invention can naturally be applied not only to an automatic sheet feeding device that employs a sheet feed cassette but also to a manual sheet feeding device by which sheets are manually inserted one by one.

Having now fully described the invention, it will be apparent to those skilled in the art that many changes and modifications can be made thereto without departing from the spirit and scope of the invention as set forth herein and defined by the appended claims.

What is claimed is:

1. A sheet feeding device comprising:

a sheet supply that supplies a plurality of sheets;

a sheet feeding roller adjacent said sheet supply that feeds a sheet from said sheet supply in a feeding direction;

a separating member disposed facing said sheet feeding roller that separates an uppermost sheet from the plurality of sheets during feeding, wherein said separating member has a high coefficient of friction; and a noise deadening member disposed independent from and facing said sheet feeding roller downstream from said separating member in the feeding direction, wherein said noise deadening member has a coefficient of friction lower than the coefficient of friction of said separating member, wherein said sheet feeding roller has a circumferential surface that extends over both said separating member and said noise deadening member.

2. The sheet feeding device of claim 1, wherein said circumferential surface of said sheet feeding roller simultaneously contacts both said separating member and said noise deadening member.

3. The sheet feeding device of claim 1, wherein said sheet feeding roller has a coefficient of friction that is greater than the coefficient of friction of said separating member.

4. The sheet feeding device of claim 3, wherein the coefficient of friction of said sheet feeding roller is about 1.2 to 1.5, the coefficient of friction of said separating member is about 0.8 to 1.0 and the coefficient of friction of said noise deadening member is equal to or less than about 0.5.

5. The sheet feeding device of claim 1, wherein said separating member is formed of a material selected from the group consisting of a foamed urethane resin, a rubber material and a cork material, and wherein said noise deadening member is formed of a material selected from the group consisting of a film of very high molecular polyethylene, a PET film, a resin, and a stainless steel plate.

6. The sheet feeding device of claim 1, further comprising a holder that supports said separating member and said noise deadening member thereon so that an outer surface of said separating member and an outer surface of said noise deadening member facing said sheet feeding roller are provided on a plane surface.

7. The sheet feeding device of claim 6 wherein the holder is pivotally supported and biased upwardly against said sheet feeding roller.

8. The sheet feeding device of claim 6, further comprising a recess in said holder that receives said separating member therein, and wherein said noise deadening member is disposed over an edge of said recess downstream of said separating member.

9. The sheet feeding device of claim 6, further comprising a recess in said holder that receives said separating member and said noise deadening member therein.

10. The sheet feeding device of claim 9, wherein said noise deadening member is mounted on a spring within said recess.

11. The sheet feeding device of claim 10, wherein said noise deadening member has a chamfered upstream edge adjacent said separating member.

12. The sheet feeding device of claim 1, wherein said noise deadening member has a chamfered upstream edge adjacent said separating member.

13. The sheet feeding device of claim 1, further comprising a support member disposed adjacent and downstream of said separating member, wherein said noise deadening member is supported on said support member.

14. The sheet feeding device of claim 13, wherein said separating member and said support member are formed of a same material.

15. The sheet feeding device of claim 13, wherein said noise deadening member is a film adhered to said support member.

16. The sheet feeding device of claim 13, wherein said noise deadening member is a strip of film adhered under said separating member and over said support member.

17. The sheet feeding device of claim 1, wherein said noise deadening member is inset into an outer surface of said separating member.

18. A sheet feeding assembly, comprising:

supply means for supplying a plurality of sheets to a sheet feed path;

feeding means for feeding sheets from said supply means into said feed path, said feeding means being located adjacent said supply means;

separating means facing said feeding means for separating an uppermost sheet from the plurality of sheets during feeding; and damping means for silencing noise and vibrations opposed to and facing said feeding means and adjacent said separating means downstream in the feed path, wherein said feeding means has a first coefficient of friction, said separating means has a second coefficient of friction, and said damping means has a third coefficient of friction, said first coefficient of friction being higher than said second coefficient of friction, and said second coefficient of friction being higher than said third coefficient of friction.

19. The sheet feeding assembly of claim 18, wherein said separating means and said damping means each have an outer surface that contacts said feeding means, and wherein in operation when said feeding means feeds a sheet in the feed path said each outer surface is flush with respect to each other.

20. The sheet feeding assembly of claim 18, wherein said damping means comprises a resilient support with a member disposed thereon, said member being selected from the group consisting of very high molecular polyethylene film, PET film, resin, and stainless steel plate.

21. The sheet feeding assembly of claim 18, further comprising a holder means for holding said separating means and said damping means, wherein said holder means has a recess defined therein and at least said separating means is disposed in said recess.

22. The sheet feeding assembly of claim 21, wherein said damping means is mounted on a spring to be movably biased between said feeding means and said holder means.

23. The sheet feeding assembly of claim 18, wherein said separating means comprises a resilient member having an outer surface, and said damping means comprises a layer disposed on said separating means inset into said outer surface.

24. The sheet feeding assembly of claim 18, wherein said separating means comprises a resilient member selected from the group consisting of foamed urethane resin, rubber, and cork.

25. The sheet feeding assembly of claim 18, wherein said first coefficient of friction is about 1.2–1.5, said second coefficient of friction is about 0.8–1.0, and said third coefficient of friction is about at most 0.5.

* * * * *